US008672659B2

(12) United States Patent
Nakajoh

(10) Patent No.: US 8,672,659 B2
(45) **Date of Patent: *Mar. 18, 2014**

(54) VANE AIR MOTOR WITH PREVENTION OF LEAKING RADIAL BEARING GREASE

(75) Inventor: Takashi Nakajoh, Tokyo (JP)

(73) Assignee: Nitto Kohki Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/177,013

(22) Filed: Jul. 6, 2011

(65) Prior Publication Data

US 2011/0262289 A1 Oct. 27, 2011

Related U.S. Application Data

(63) Continuation of application No. PCT/JP2010/050019, filed on Jan. 5, 2010.

(30) Foreign Application Priority Data

Jan. 8, 2009 (JP) ..... 2009-002306

(51) Int. Cl.

| | |
|---|---|
| ***F03C 2/00*** | (2006.01) |
| ***F01C 1/344*** | (2006.01) |
| ***F04C 2/344*** | (2006.01) |
| ***F04C 18/344*** | (2006.01) |

(52) U.S. Cl.

USPC ..... 418/270; 418/228; 418/229

(58) Field of Classification Search

USPC ..... 418/270, 228, 229

See application file for complete search history.

(56) References Cited

U.S. PATENT DOCUMENTS

| | | | | |
|---|---|---|---|---|
| 2,925,089 | A * | 2/1960 | Rockwood et al. | 418/270 |
| 4,631,012 | A * | 12/1986 | Eckman | 418/270 |
| 4,659,297 | A | 4/1987 | Kahrs | |
| 5,525,097 | A | 6/1996 | Kakimoto | |
| 6,393,837 | B1 | 5/2002 | Tomioka | |
| 8,439,662 | B2 * | 5/2013 | Nakajoh | 418/270 |
| 2011/0262292 | A1 * | 10/2011 | Nakajoh | 418/64 |

FOREIGN PATENT DOCUMENTS

| | | | |
|---|---|---|---|
| JP | 50-108078 | U | 9/1975 |
| JP | 61-142372 | A | 6/1986 |
| JP | 08-049504 | A | 2/1996 |
| JP | 2001-009695 | A | 1/2001 |

(Continued)

OTHER PUBLICATIONS

International Search Report for International Application No. PCT/JP2010/050019, dated Mar. 23, 2010, 2 pages.

(Continued)

*Primary Examiner* — Mary A Davis

(74) *Attorney, Agent, or Firm* — Brinks Gilson & Lione

(57) ABSTRACT

A vane air motor is disclosed which is configured to prevent grease in a radial bearing from leaking into a rotor chamber. The vane air motor has a motor housing (20) having a rotor chamber, a rotor (22) with vanes (24) disposed in the rotor chamber, a first end wall (16) of the motor housing equipped with a radial bearing (50) rotatably supporting a support shaft portion (28) of the rotor, and a casing contiguously joined to the motor housing to form a compressed air supply chamber (44) together with the first end wall to supply compressed air into the rotor chamber through an air supply hole (46) formed in the first end wall. The first end wall has communication means (16-5, 16-6 and 16-7) for supplying compressed air from the compressed air supply chamber to the side of the first radial bearing closer to the rotor.

4 Claims, 4 Drawing Sheets

(56) References Cited

FOREIGN PATENT DOCUMENTS

| | | | |
|---|---|---|---|
| JP | 2007-535639 | A | 12/2007 |
| TW | 265297 | | 11/1983 |
| TW | M 306283 | U | 2/2007 |
| WO | WO 2005/110252 | A2 | 11/2005 |

OTHER PUBLICATIONS

Office Action from counterpart Chinese Application No. 201080007989.9, dated Nov. 2, 2012, 12 pages (with translation).

* cited by examiner

VANE AIR MOTOR WITH PREVENTION OF LEAKING RADIAL BEARING GREASE

RELATED APPLICATIONS

This application is a continuation of PCT/JP2010/050019 filed on Jan. 5, 2010, which claims priority to Japanese Application No. 2009-002306 filed on Jan. 8, 2009. The entire contents of these applications are incorporated herein by reference.

BACKGROUND OF THE INVENTION

1. Field of the Invention

The present invention relates to a vane air motor usable as driving means for pneumatic grinders and so forth.

2. Description of the Related Art

Conventionally, a vane air motor has a motor housing having a circular cylindrical inner peripheral surface defining a rotor chamber in the motor housing and a rotor eccentrically and rotatably installed in the motor housing and having vanes. The rotor has an output shaft portion projecting from one end surface of the rotor along the axis of rotation of the rotor. The output shaft portion is rotatably supported by an end wall of the motor housing. The rotor further has a support shaft portion projecting from the other end surface of the rotor in coaxial relation to the output shaft portion. The support shaft portion is rotatably supported by another end wall of the motor housing. The vane air motor further has a governor having a shaft-shaped rotating member coaxially secured to the support shaft portion to rotate together with the support shaft portion. When the shaft-shaped rotating member is rotated at a number of revolutions greater than a predetermined one, the governor limits a compressed air supply flow path supplying compressed air into the rotor chamber to suppress the number of revolutions of the rotor.

The output shaft portion and the support shaft portion are supported by radial bearings provided in the end walls, respectively, of the housing. The radial bearings comprise inner races secured to the output and support shaft portions, respectively, outer races provided radially outward of the respective inner races, and spherical or circular cylindrical rolling members provided between respective combinations of inner and outer races.

The motor housing and the governor are enclosed by a casing of a pneumatic grinder or the like to which the vane air motor is attached, and compressed air to be supplied into the rotor chamber is supplied through a compressed air supply chamber formed around the governor by the casing and through an air supply hole formed in the motor housing (Patent Literature 1 noted below).

Patent Literature: Patent Literature 1: Japanese Patent Application Publication No. 2001-9695

In the vane air motor having the above-described structure, the pressure in the compressed air supply chamber, in which the governor is disposed, is higher than in the rotor chamber in which the rotor is disposed. The rotor chamber and the compressed air supply chamber are divided from each other by the end wall of the motor housing which end wall receives the support shaft portion of the rotor extending therethrough and supports it by means of the radial bearing. Therefore, the above-noted difference in pressure causes grease in the radial bearing to gradually leak into the rotor chamber. Grease entering the rotor chamber adheres to vane end portions near the above-described end wall. Because of its high viscosity, the grease hinders smooth radial movement of the blades relative to the rotor. However, such does not occur at the radial bearing in the other end wall of the motor housing, and no grease adheres to vane end portions near the other end wall. Consequently, each blade is inclined between one end and the other end thereof. For this reason, the distal edge of each vane is pressed against the cylindrical wall surface with a stronger force at one end of the distal edge near the above-described other end wall than the other end of the same, and it is likely that the one end of the distal edge of the vane will become worn or broken.

SUMMARY OF THE INVENTION

An object of the present invention is to solve the above-described problem.

The present invention provides a vane air motor comprising a motor housing having a cylindrical wall with a circular cylindrical inner peripheral surface and first and second end walls attached to the opposite ends, respectively, of the cylindrical wall, to thereby define a rotor chamber in the motor housing. The vane air motor further comprises a rotor provided in the motor housing to extend along an axis of rotation parallel to and spaced from the center axis of the cylindrical inner peripheral surface. The rotor has an output shaft portion extending through the second end wall and a support shaft portion extending into the first end wall. Further, the vane air motor comprises vanes fitted to the rotor, first and second radial bearings attached to the first and second end walls, respectively, to rotatably support the support shaft portion and the output shaft portion, respectively, and a casing contiguously joined to the motor housing to form a compressed air supply chamber together with the first end wall to supply compressed air into the rotor chamber through an air supply hole formed in the first end wall. The first end wall has an end wall portion having an inner end surface abutting against an end surface of the cylindrical wall to define the rotor chamber together with the cylindrical inner peripheral surface of the cylindrical wall and an outer end surface opposite to the inner end surface in the axial direction of the rotor. The end wall portion further has a circular cylindrical hole extending through the first end wall in the axial direction of the rotor to receive the support shaft portion of the rotor therethrough. The first end wall further has a circular cylindrical wall portion extending from the outer end surface into the compressed air supply chamber opposite to the rotor chamber to define a bearing-housing recess housing the first radial bearing. The cylindrical wall portion has an inner peripheral surface to which an outer peripheral surface of an outer race of the first radial bearing is fitted and secured. The first radial bearing comprises the outer race, an inner race fitted and secured to an outer peripheral surface of the support shaft portion in coaxial relation to the outer race, and a plurality of rolling members provided between the outer race and the inner race. The first end wall has a communication groove extending from an end surface of the cylindrical wall portion to the outer end surface of the end wall portion along the inner peripheral surface of the cylindrical wall portion.

In this vane air motor, a communication groove is provided to extend from an end surface of the cylindrical wall portion to the outer end surface of the end wall portion along the inner peripheral surface of the cylindrical wall portion. Therefore, the air pressure in the compressed air supply chamber is transmitted as far as the side of the radial bearing closer to the rotor chamber through the communication groove, so that a substantially uniform air pressure acts on both the front and rear of the radial bearing (i.e., both sides of the radial bearing that are closer to the rotor chamber and the compressed air supply chamber, respectively), thereby making it possible to prevent the above-described leakage of grease from the radial bearing into the rotor chamber. Accordingly, it is possible to prevent the above-described problem that grease entering the rotor chamber adheres to the end portions of the vanes and causes the vanes to be inclined, resulting in that only one end of the vane distal edge slides against the cylindrical wall surface of the rotor chamber and is eventually worn excessively or broken.

Specifically, the outer end surface of the end wall portion may have a communication recess communicating with the communication groove. The communication recess is facing the radial bearing. More specifically, the communication recess may have an annular recess formed on the outer end surface of the end wall portion to extend circumferentially along the outer end surface radially outward of the cylindrical hole, and a radial recess formed on the outer end surface to extend radially from the annular recess to communicate with the communication groove. The purpose of this structure is to surely transmit the air pressure to the side of the radial bearing closer to the rotor chamber.

The vane air motor according to the present invention may comprise, in addition to the above-described constituent elements, a governor having a shaft-shaped rotating member secured to an end of the support shaft portion in coaxial relation thereto to rotate together with the support shaft portion. When the shaft-shaped rotating member is rotated at a number of revolutions greater than a predetermined one, the governor limits an air supply flow path provided in the casing to supply compressed air into the compressed air supply chamber to suppress the number of revolutions of the rotor. The shaft-shaped rotating member of the governor may have a flange extending radially of the shaft-shaped rotating member. The flange has an annular surface placed in close proximity to an end surface of the outer race remote from the rotor chamber. With this structure, when the shaft-shaped rotating member of the governor rotates in response to the rotation of the rotor, the flange rotates in close proximity to the outer race. Therefore, it is possible to prevent the air pressure of compressed air in the compressed air supply chamber from acting directly between the inner and outer races of the radial bearing, and hence possible to reduce the above-described leakage of grease.

Further, in the present invention, the end wall portion of the first end wall may have a radial hole extending through the end wall portion radially outward from the wall surface of the cylindrical hole and opening on the outer peripheral surface of the end wall portion to communicate with the atmosphere. With this structure, even if grease leaks from the radial bearing toward the rotor chamber, the grease can be discharged to the outside before reaching the rotor chamber.

An embodiment of the vane air motor according to the present invention will be explained below with reference to the accompanying drawings.

DETAILED DESCRIPTION OF THE PREFERRED EMBODIMENTS

Figure 1:
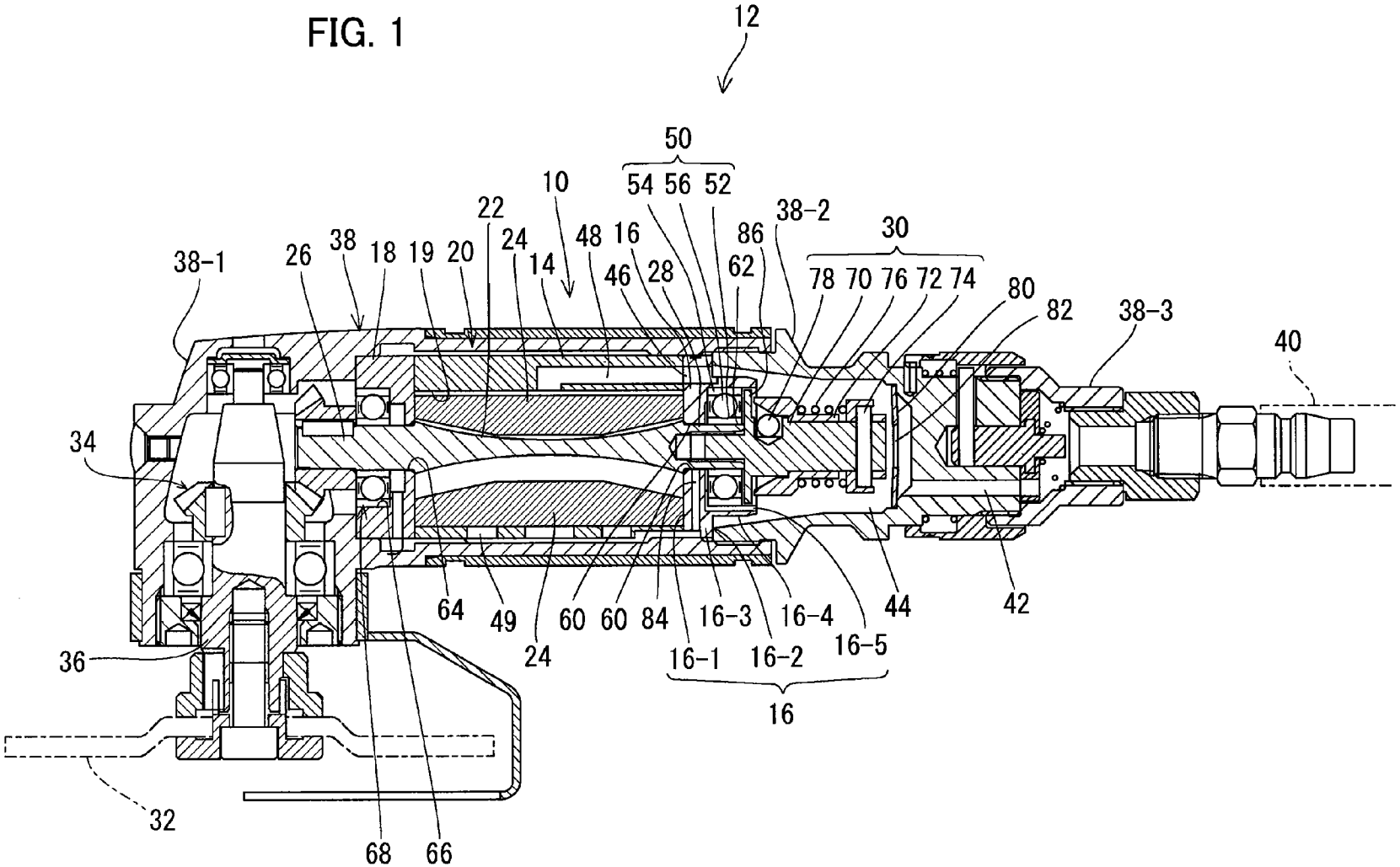
FIG. 1 is a longitudinal sectional side view of a vane air motor according to the present invention.

FIG. 1 shows a pneumatic grinder (polishing machine) 12 having a vane air motor 10 according to the present invention.

The vane air motor 10 has a motor housing 20 having a cylindrical wall 14 with a circular cylindrical inner peripheral surface and first and second end walls 16 and 18 provided at the opposite ends, respectively, of the cylindrical wall 14. The motor housing 20 has a rotor chamber 19 formed therein. The vane air motor 10 further has a rotor 22 eccentrically provided in the rotor chamber 19, a plurality of vanes 24 fitted to the rotor 22, and a support shaft portion 28 and an output shaft portion 26 that extend from the opposite ends of the rotor 22 along the axis of rotation of the rotor 22 and that are supported by the first and second end walls 16 and 18, respectively. The vane air motor 10 has a governor 30 attached to an end of the support shaft portion 28. The output shaft portion 26 is drivably connected to a rotating shaft 36 of a disk-shaped abrasive member 32 through a bevel gear 34.

The rotating shaft 36, the vane air motor 10 and the governor 30 are housed in a casing 38 of the pneumatic grinder 12. The casing 38 comprises a plurality of casing parts 38-1 to 38-3. The casing part 38-3 receives compressed air through a hose 40 connected to an air pump (not shown). The received compressed air is supplied into a compressed air supply chamber 44 through a communicating hole 42 extending through the casing part 38-3. The compressed air supply chamber 44 is formed around the governor 30 by the casing part 38-3 and the first end wall 16. The compressed air is further supplied into the rotor chamber 19 through air supply holes 46 and 48 provided at an upper position (as seen in the figure) of the first end wall 16 and the cylindrical wall 14, respectively, to act on the vanes 24, thereby causing the rotor 20 to rotate, and thus rotationally driving the abrasive member 32. The compressed air having acted on the vanes 24 is discharged into the atmosphere through exhaust holes 49.

Figure 4:
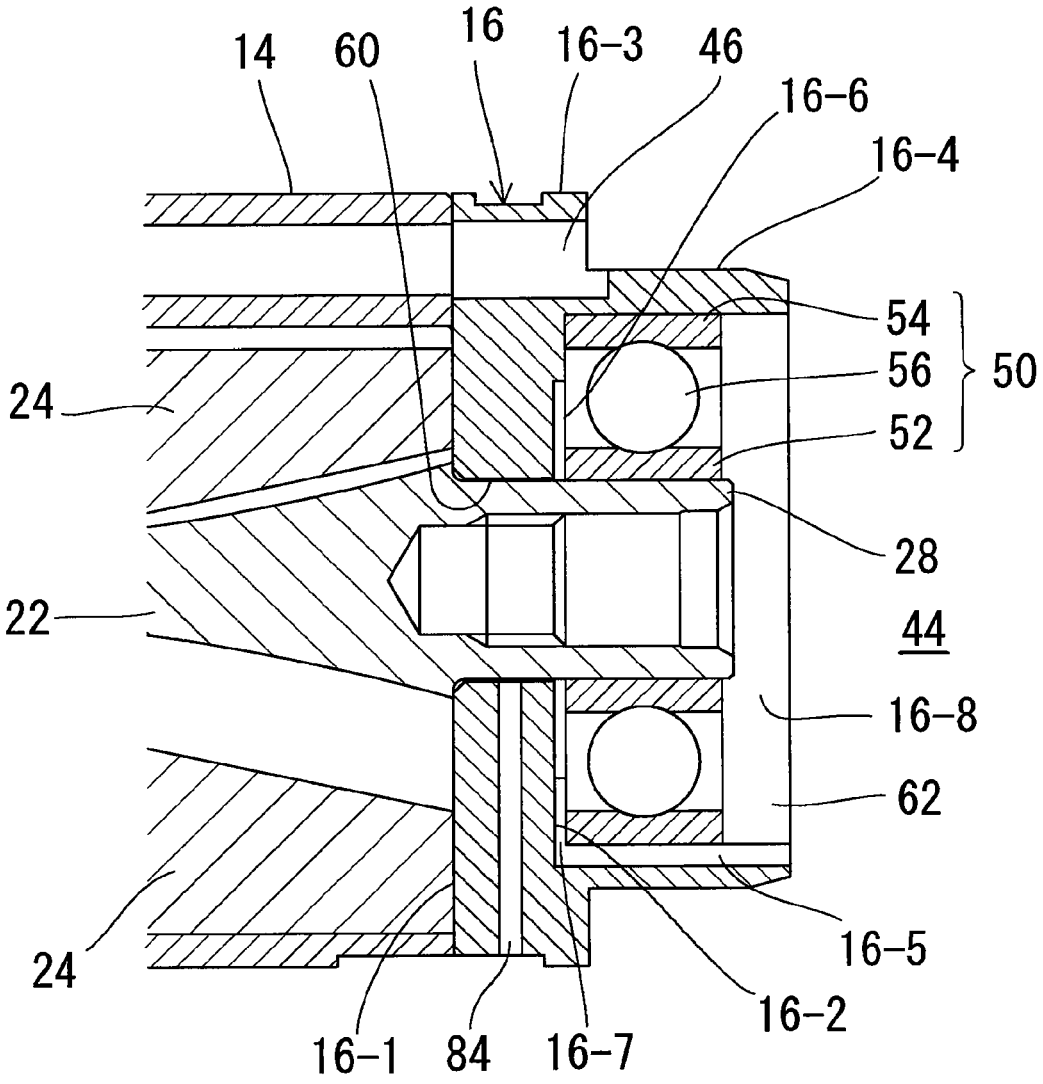
FIG. 4 is an enlarged sectional side view of the first end wall having a radial bearing installed therein.

The first end wall 16 is, as shown clearly in FIG. 4, provided with a circular cylindrical hole 60 communicating with the rotor chamber 19 and receiving the support shaft portion 28 therethrough and a bearing-housing recess 62 formed contiguous with the cylindrical hole 60 at the side of the first end wall 16 remote from the rotor chamber 19. A radial bearing 50 is provided in the bearing-housing recess 62. The radial bearing 50 has an inner race 52 secured around the support shaft portion 28, an outer race 54 secured in the bearing-housing recess 62 at a position radially outward of the inner race 52, and bearing balls 56 provided between the inner race 52 and the outer race 54. The radial bearing 50 rotatably supports the support shaft portion 28. Similarly, the second end wall 18 has a circular cylindrical hole 64 receiving the output shaft portion 26 therethrough, a bearing-housing recess 66, and a radial bearing 68.

The governor 30 has a shaft-shaped rotating member 70 coaxially secured to the end of the support shaft portion 28, a sleeve 72 slidably provided around the shaft-shaped rotating member 70, a pin 74 provided to extend diametrically through the shaft-shaped rotating member 70, a coil spring 76 provided between the pin 74 and the sleeve 72 to urge the sleeve 72 leftward as seen in the figure, and a ball 78 housed in a radial hole provided in the shaft-shaped rotating member 70. The ball 78 is engaged with a tapered surface provided on the sleeve 72 and pressed radially by the urging force of the coil spring 76. When the rotor 20 is rotated at a number of revolutions greater than a predetermined one, together with the shaft-shaped rotating member 70, the ball 78 moves radially outward by centrifugal force, thus urging the tapered surface of the sleeve 72 to be displaced rightward as seen in the figure. A coned disk spring 80 is provided at a position adjacent to a right-end surface of the shaft-shaped rotating member 70 so as to extend across the compressed air supply chamber 44 near the right end of the latter. The coned disk spring 80 has an air inlet hole 82 formed in the center thereof to introduce compressed air passed through the communicating hole 42 of the casing part 38-3 into the compressed air supply chamber 44. When the sleeve 72 is displaced rightward as stated above, the sleeve 72 closes the air inlet hole 82 of the coned disk spring 80 to suppress the supply of compressed air into the rotor chamber 19, thereby suppressing the rotation of the rotor 22. The shaft-shaped rotating member 70 of the governor 30 is provided with a flange 86 extending radially of the rotating member 70. A surface of the flange 86 that faces the radial bearing 50 is placed in close proximity to an end surface of the outer race 54 of the radial bearing 50 so that the pressure of compressed air in the compressed air supply chamber 44 acts on the inside of the radial bearing 50 after it has been reduced, thereby suppressing grease in the radial bearing 50 from being pushed out toward the rotor chamber 19.

In the present invention, the following means is further provided to prevent grease in the radial bearing 50 from being pushed out into the rotor chamber 19 by the effect of compressed air in the compressed air supply chamber 44.

Figure 2:
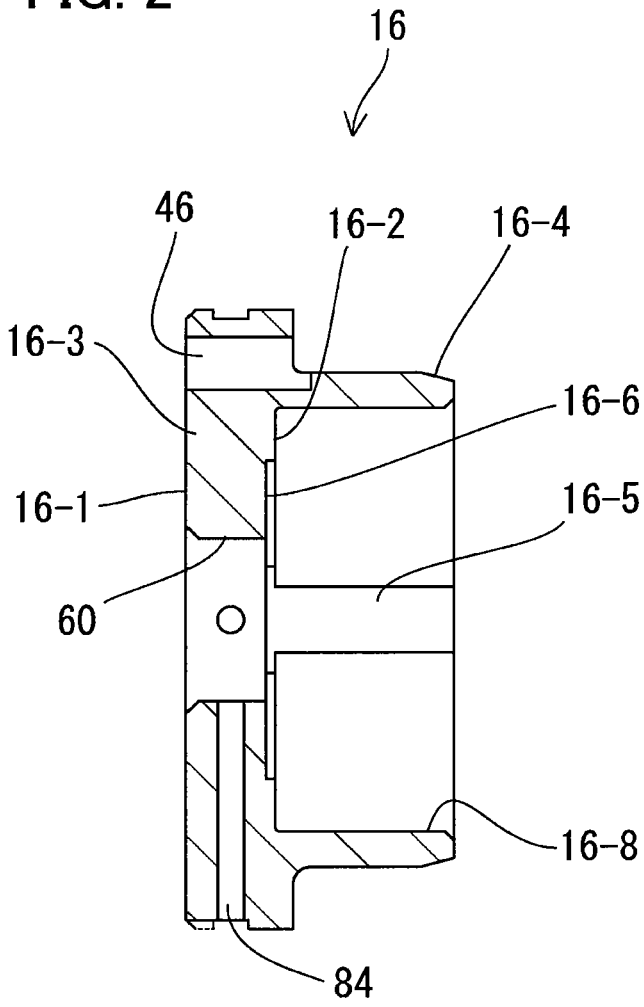
FIG. 2 is a sectional side view of a first end wall defining a rotor chamber of the vane air motor shown in FIG. 1.
Figure 3:
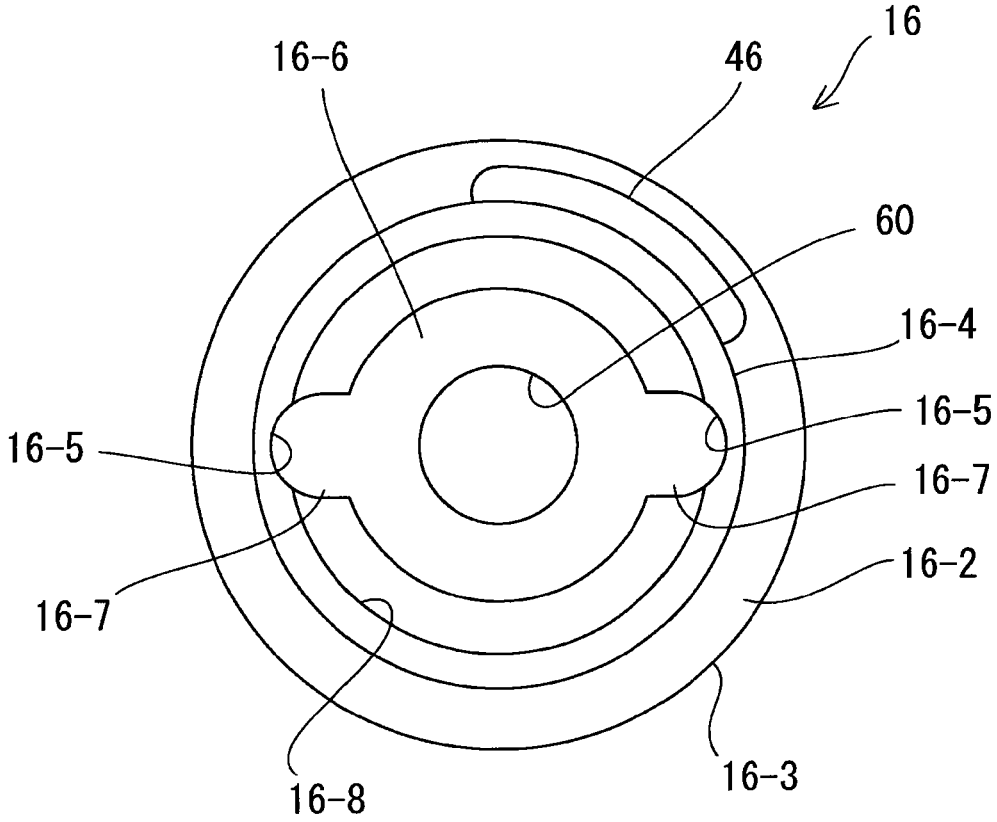
FIG. 3 is an end view of the first end wall shown in FIG. 2.

That is, as shown in FIGS. 2 to 4, the first end wall 16 has an end wall portion 16-3 having an inner end surface 16-1 abutting against the end surface of the cylindrical wall 14 to define the rotor chamber 19 together with the cylindrical inner peripheral surface of the cylindrical wall 14. The end wall portion 16-3 further has an outer end surface 16-2 opposite to the inner end surface 16-1. Further, the first end wall 16 has a circular cylindrical wall portion 16-4 extending axially from the end wall portion 16-3 to define the bearing-housing recess 62. The first end wall 16 has a pair of communication grooves 16-5 extending from the end surface of the cylindrical wall portion 16-4 to the outer end surface 16-2 of the end wall portion 16-3 along the inner peripheral surface of the cylindrical wall portion 16-4. The communication grooves 16-5 allow the air pressure in the compressed air supply chamber 44 to be transmitted to the side of the radial bearing 50 closer to the rotor chamber 19. Further, in the present invention, the first end wall 16 has an annular recess 16-6 and a pair of radial recesses 16-7 on the outer end surface 16-2 of the end wall portion 16-3. The annular recess 16-6 is formed around the cylindrical hole 60. The radial recesses 16-7 extend radially from the annular recess 16-6 to communicate with the communication grooves 16-5, respectively.

With the above-described structure, the air pressure in the compressed air supply chamber 44 is applied on both the front and rear of the radial bearing 50 (i.e. both sides of the radial bearing 50 that are closer to the rotor chamber 19 and the compressed air supply chamber 44, respectively), thereby suppressing grease from being pushed out of the radial bearing 50 toward the rotor chamber 19.

Further, in the present invention, the end wall portion 16-3 of the first end wall 16 is provided with a radial hole 84 extending radially from the cylindrical hole 60 and opening on the outer peripheral surface of the end wall portion 16-3, so that grease that may be pushed out slightly from the radial bearing 50 flows out through the radial hole 84 to the outside of the cylindrical wall 14 having the rotor chamber 19.

The vane air motor 10 according to the present invention, which has the above-described structure, will make it possible to prevent leakage of grease from the radial bearing into the rotor chamber, which has been experienced with the conventional vane air motor. Further, in the vane air motor, a flange is provided on the shaft-shaped rotating member of the governor, and an annular surface of the flange is placed in close proximity to the end surface of the outer race. Because the annular surface rotates at a high speed relative to the end surface of the outer race, it forms a large flow path resistance with respect to a flow path through which the compressed air in the compressed air supply chamber formed around the governor passes to reach the radial bearing through the area between the annular surface and the end surface, whereby suppress grease in the radial bearing is suppressed from being pushed out into the rotor chamber by the compressed air. Accordingly, it is possible to prevent the problem that grease entering the rotor chamber adheres to the end portions of the vanes and causes the vanes to be inclined, resulting in that only one end of the vane distal edge slides against the cylindrical wall surface of the rotor chamber and is eventually worn excessively or broken.

What is claimed is:

1. A vane air motor comprising:

a motor housing comprising a cylindrical wall with a circular cylindrical inner peripheral surface, and first and second end walls that define opposite ends of the cylindrical wall, respectively, such that the circular cylindrical inner peripheral surface and the first and second end walls define a rotor chamber in the motor housing;

a rotor provided in the motor housing for rotation around an axis of rotation extending parallel to and spaced from a center axis of the circular cylindrical inner peripheral surface, the rotor having an output shaft portion extending through the second end wall and a support shaft portion extending into the first end wall;

first and second radial bearings that are attached to the first end wall and the second end wall, respectively, and rotatably support the support shaft portion and the output shaft portion, respectively; and a casing joined to the motor housing to form a compressed air supply chamber together with the first end wall, the first end wall being formed with an air supply hole through which compressed air is supplied into the rotor chamber;

the first end wall comprising:

an end wall portion having an inner end surface abutting against an end surface of the cylindrical wall to define the rotor chamber, together with the circular cylindrical inner peripheral surface of the cylindrical wall, and an outer end surface located axially opposite to the inner end surface, the end wall portion further having a circular cylindrical hole which extends through the first end wall in the axial direction of the rotor and receives the support shaft portion of the rotor so as to allow the support shaft portion to rotate in the circular cylindrical hole; and a circular cylindrical wall portion extending opposite to the rotor chamber from the outer end surface into the compressed air supply chamber to define a bearing-housing recess which houses the first radial bearing;

the first end wall being formed with a communication groove communicating with the compressed air supply chamber and extending to the outer end surface of the end wall portion, the outer end surface of the end wall portion being formed with a communication recess forming an air passage configured in a loop around the circular cylindrical hole which at least partially faces and thus communicates with a front end of the first radial bearing opposite to a rear end thereof facing the compressed air supply chamber, the communication recess and the communication groove being in communication with each other and constituting an isolated channel to substantially uniformly pressurize the front and rear ends of the first radial bearing in order to prevent leaking of grease from the first radial bearing.

2. The vane air motor of claim 1, wherein the communication recess comprises an annular recess formed in the outer end surface of the end wall portion around the cylindrical hole, and a radial recess formed in the outer end surface to extend radially from the annular recess to communicate with the communication groove.

3. The vane air motor of claim 1, further comprising:

a governor having a shaft-shaped rotating member secured to an end of the support shaft portion coaxially with the support shaft portion so as to rotate together with the support shaft portion, wherein, when the shaft-shaped rotating member rotates faster than a predetermined speed, the governor limits an air supply of compressed air to the air supply hole of the motor housing to lower a rotational speed of the rotor;

the shaft-shaped rotating member of the governor having a flange extending radially of the shaft-shaped rotating member, the flange having an annular surface placed in close proximity to the other axial end of the first radial bearing.

4. The vane air motor of claim 1, wherein the end wall portion of the first end wall has a radial hole extending through the end wall portion radially outward from a wall surface of the circular cylindrical hole and opening on an outer peripheral surface of the end wall portion to communicate with atmosphere.

* * * * *